356-400 SR
XR 4,034,490

United Stat
Teach

[11] 4,034,490
[45] July 12, 1977

[54] AUTOMATIC DEPTH CONTROL FOR ENDLESS CHAIN TYPE TRENCHER

[75] Inventor: Ted L. Teach, Dayton, Ohio

[73] Assignee: Laserplane Corporation, Dayton, Ohio

[21] Appl. No.: 628,095

[22] Filed: Nov. 3, 1975

[51] Int. Cl.[2] ..... E02F 5/06; E02F 9/20; E02F 9/26; G05G 15/04

[52] U.S. Cl. ..... 37/86; 33/264; 33/DIG. 21; 37/DIG. 1; 37/DIG. 19; 37/DIG. 20; 73/432 L; 356/172

[58] Field of Search ..... 37/DIG. 1, DIG. 19, 37/DIG. 20, 80 R, 83, 86–90, DIG. 11, 80; 172/4.5; 116/124 F; 73/432 L; 33/DIG. 21, 286, 264; 250/215; 356/172

[56] References Cited

U.S. PATENT DOCUMENTS

| | | | |
|---|---|---|---|
| 1,300,371 | 4/1919 | French | 37/DIG. 19 |
| 2,580,954 | 1/1952 | Przybylski | 37/DIG. 19 |
| 2,919,505 | 1/1960 | Bethany | 37/DIG. 19 |
| 3,044,194 | 7/1962 | Balkheimer | 37/86 A |
| 3,058,242 | 10/1962 | Ocnaschek | 172/4.5 |
| 3,557,372 | 1/1971 | Ede | 37/DIG. 20 |
| 3,727,332 | 4/1973 | Zimmer | 37/DIG. 20 |
| 3,750,299 | 8/1973 | Plasser et al. | 33/DIG. 21 |
| 3,778,168 | 12/1973 | Willner | 172/4.5 X |
| 3,813,171 | 5/1974 | Teach et al. | 37/DIG. 20 |
| 3,887,012 | 6/1975 | Scholl et al. | 37/DIG. 20 |

FOREIGN PATENT DOCUMENTS

| | | | |
|---|---|---|---|
| 491,649 | 3/1953 | Canada | 37/DIG. 20 |
| 1,944,998 | 9/1969 | Germany | 37/DIG. 1 |
| 1,484,667 | 2/1961 | Germany | 37/DIG. 19 |
| 617,339 | 8/1935 | Germany | 116/124 F |
| 1,049,793 | 1/1959 | Germany | 37/80 R |
| 1,938,444 | 2/1971 | Germany | 37/80 R |
| 150,071 | 10/1931 | Switzerland | 116/124 F |
| 121,245 | 11/1959 | U.S.S.R. | 250/215 |
| 192,078 | 1/1967 | U.S.S.R. | 37/DIG. 20 |
| 156,488 | 10/1962 | U.S.S.R. | 37/86 |
| 244,205 | 10/1969 | U.S.S.R. | 37/80 R |

*Primary Examiner*—Edgar S. Burr
*Assistant Examiner*—Steven A. Bratlie

[57] ABSTRACT

The cutting depth of an endless chain type trencher is normally determined by the angle of the frame carrying the endless chain relative to the horizontal. In accordance with this invention, the angular position of the digging frame is controlled by one or more hydraulic cylinders which, in turn, are controlled by signals derived from sensors carried by an upstanding vertical mast mounted to the frame which detects a reference plane defined by a rotating laser beam. A trigonometric correction factor to compensate for the mast mounting is included.

5 Claims, 4 Drawing Figures

AUTOMATIC DEPTH CONTROL FOR ENDLESS CHAIN TYPE TRENCHER

BACKGROUND OF THE INVENTION

A variety of endless chain type trenchers have heretofore been utilized. Normally, such trenchers comprise an elongated frame having one end thereof pivotally mounted on a vehicle for movement in a vertical plane parallel to the path of travel of the vehicle. The digging frame provides a mounting for a power-driven endless chain carrying a plurality of spaced digging scoops. Thus the depth of the trench to be dug is determined by the angular position of the digging frame with respect to the horizontal, hereinafter called the digging frame angle. Such angular position can be determined by hydraulic cylinders appropriately connected between the digging frame and the vehicle. If the vehicle is moving over perfectly level ground, then it becomes a simple matter to control the depth of the trench being dug as a function of the angular position of the digging frame with respect to the horizontal; however, few if any trenching jobs involve perfectly level terrain and hence the angular position of the digging frame relative to the horizontal becomes an unreliable indicator of the trench depth as soon as the vehicle wheels or track encounter uneven terrain.

It has heretofore been proposed, for example in Studebaker U.S. Pat. No. 3,494,426, to control the working depth of an earth-working implement by attaching an upstanding mast to such implement and providing a plurality of vertically stacked sensors at the top of the said mast capable of detecting a reference plane defined by a rotating laser beam. If this type of control system were applied to a trencher, it would not result in an accurate control of the exact depth of the trench being dug by the endless chain because the lowermost digging point of such chain does not move vertically up or down but only moves arcuately about the pivotal mounting point of the trencher on the vehicle. More importantly, it is physically impossible to mount a vertically extending mast at exactly the lowest effective digging point of the endless chain. Instead, the mast must necessarily be mounted on a cantilevered subframe which has its forward end secured to the digging frame at an above ground level and its rearward end overlying the reaward portions of the digging chain. Thus, the resulting motions of the mast as the digging depth is varied, or when the vehicle wheels or track encounters an unevenness in the terrain, is an arcuate motion in a vertical plane about the pivotal mounting point of the digging frame on the vehicle.

OBJECTS OF THE INVENTION

Accordingly, it is an object of this invention to provide an improved mechanism for controlling the depth of a trench produced by an endless chain type pivotally mounted trencher. In particular, it is an object of this invention to provide a trench depth control system responsive to a reference plane defined over the working area of the trencher by a rotating laser beam.

A specific object of the invention is to provide a depth control for an endless chain type trencher mounted on a frame which pivotally secured to a vehicle, wherein the depth control signals derived from an overhead laser beam reference plane are modified by a factor trigonometrically related to the angle of inclination of the digging frame relative to the horizontal.

Other objects and advantages of the invention will become apparent to those skilled in the art from the following detailed description, taken in conjunction with the annexed sheets of drawings.

DESCRIPTION OF DRAWINGS

In FIG. 1 there is schematically shown a tractor type vehicle 1 having means thereon for pivotally mounting an endless chain type trencher 10 at the rear end of the tractor. Trencher 10 comprises a digging frame 11 having the forward end thereof secured to a pivot shaft 2 carried by vehicle 1. A pair of crank arms **12*a* and 12*b* are respectively rigidly secured to frame 11 and the ends thereof are respectively secured to actuating cylinders 13*a* and 13*b* which are respectively pivotally mounted on vehicle 1 on pins 1*a* and 1*b*. Thus the digging frame 11 may be shifted in a vertical plane about the pivotal mounting shaft 2 from an inoperative position wherein the digging frame 11 is completely above the ground, to a digging position where the rear end of digging frame 11** is disposed below the ground level.

Figure 1:
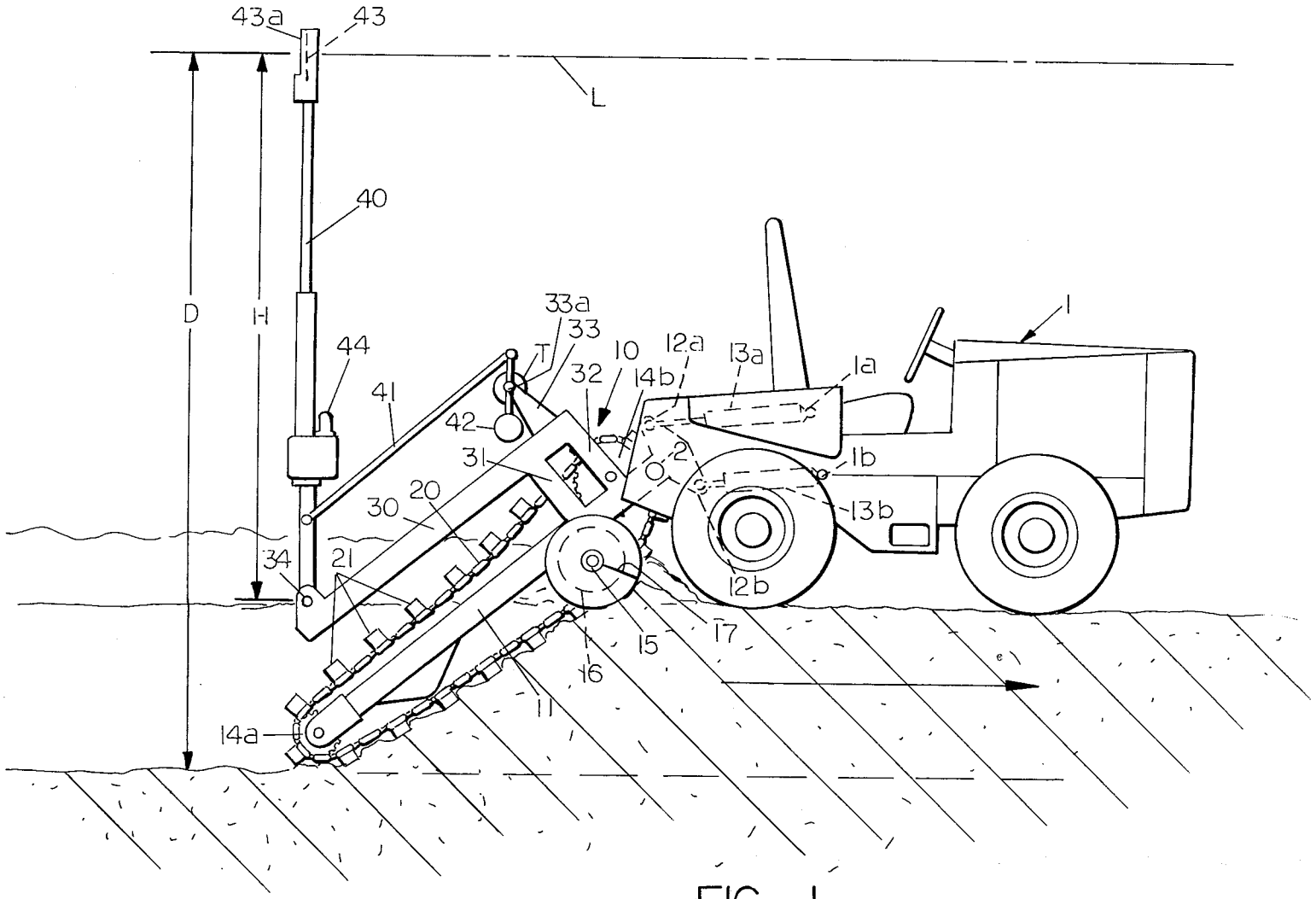
FIG. 1 is a side elevational, schematic view of effective height trencher embodying this invention.

suitable chain sprockets **14*a* and 14*b* are provided at each end of the digging frame 11 and are driven by power means (not shown) on vehicle 1. Sprockets 14*a* and 14*b* in turn drive an encircling digging chain 20 carrying digging scoops 21 around its periphery. At an intermediate point on the frame 11, a horizontal shaft 15 is provided which mounts an idler sprocket 16 driven from the endless chain 20. On both sides of shaft 15, a helical diverter 17 is mounted which moves the dirt carried upwardly by the digging scoops 21 on the endless chain 20** to a position on each side of the resulting trench.

All the mechanism heretofore described is conventional and, for this reason, is shown only in schematic fashion.

In accordance with this invention, a sub-frame 30 is provided having inverted V-shaped mounting brackets 31 and 32 rigidly secured to the top portions of digging frame 11 and straddling the chain 20. Sub-frame 30 projects downwardly and rearwardly, generally parallel to the line drawn between the rotational axes of the chain sprockets **14*a* and 14*b*. At a point on the rear end of sub-frame 30, a laser beam detecting mast 40 is pivotally mounted on a pin 34 for movements in the same vertical plane as the digging frame 11. Mast 40 is continuously held in a true vertical position by a link connection 41 to the top end of a penduluum 42 which, in turn, is pivotally suspended on a pin 33*a* traversing the top portion of a support 33 provided on the top portion of sub-frame 30.**

Figure 2:
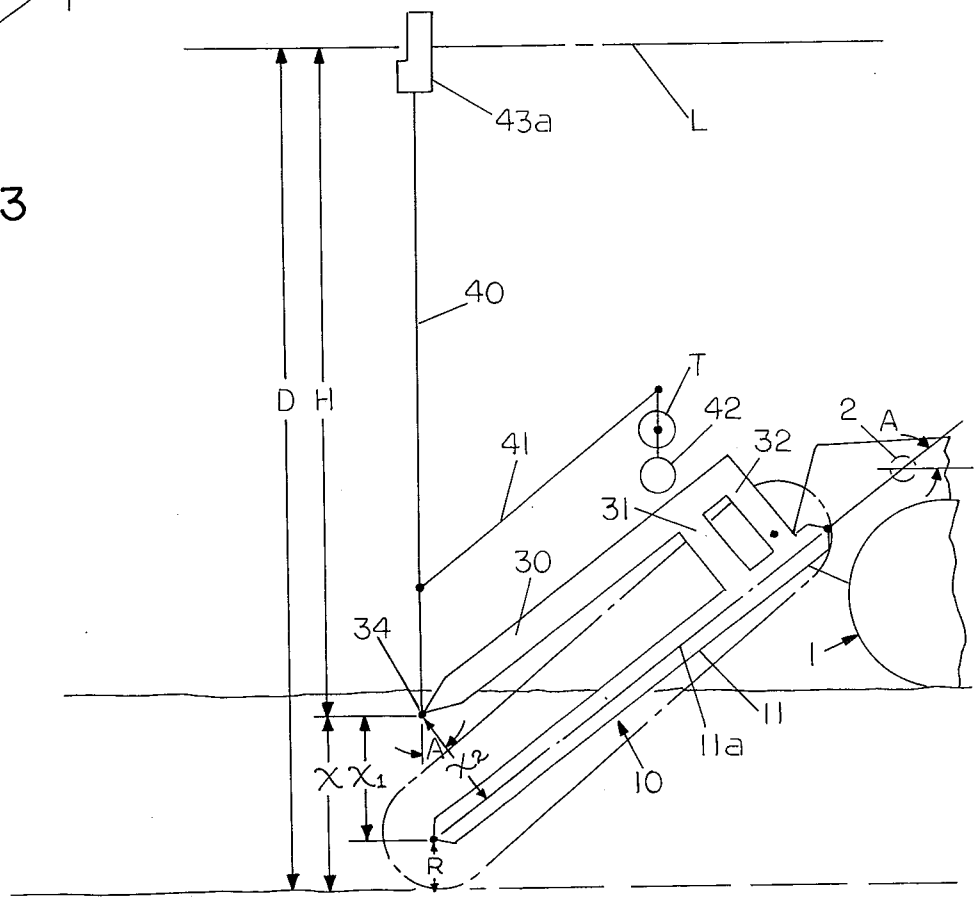
FIG. 2 is a schematic view of a portion of FIG. 1 showing the trigonometric relationship of the equipment to the depth of the trench.

Mast 40 is preferably of the type described in detail in my prior U.S. Pat. No. 3,825,808 and includes an electric motor 44 for extending or contracting the vertical height of the mast 40. As is described in said patent, a plurality of vertically stacked sensors 43 are provided in a housing **43*a* on top of mast 40 and these sensors operate to detect the reference plane defined by a rotating laser beam L. Such beam may be generated by mechanism described in Studebaker U.S. Pat. No. 3,588,245. in this In the motor 44 is utilized only to extend or contract mast 40 to initially align the center of sensors 43 with the plane of the beam L. In the event of any departure of the center of the stack of sensors from the reference plane, defined by beam L, a signal is generated which may be utilized, through conventional control circuitry, to operate the position control cylinders 13***a* and 13*b* of the trencher to move the entire trencher assembly pivotally about the mounting axis 2 and thus restore the laser beam sensors 43 to their centrally aligned position with respect to the reference plane defined by the laser beam L. In other words, through the application of control signals derived from the laser beam sensors 43, the distance H from the laser beam reference plane L to the bottom pivotal mounting point 34 of mast 40 may be maintained as a constant. So long as the wheels or track of the vehicle 1 are proceeding on level ground, it would necessarily follow that the trench depth D would also remain at a constant value. In practice, however, it is necessary to anticipate the fact that the vehicle will not be moving over level terrain and hence the digging frame angle A (FIG. 2) between the axis 11*a* of the digging frame 11 and true horizontal will vary according to variations in the terrain encountered by the vehicle 1. If it were possible to position the pivotal mounting point 34 of mast 40 in exact coincidence with the axis of the rearmost sprocket 14*a*, then the effective height of the mast 40 would vary directly with the depth of the trench being dug. Such mounting, however, is a practical impossibility, since clearance for the digging scoops 21 has to be provided. Therefore, practical design considerations require that the pivot mounting point 34 of mast 40 be positioned adjacent to but above the axis of the rearmost sprocket 14*a*. Hence the distance X, which is the vertical distance between the bottom mounting point 34 of mast 40 and the bottom of the resulting trench will vary as a trigonometric function of the digging frame angle A and, without the application of compensation factors in accordance with this invention, would result in erroneous signals being generated by the sensors 43 carried by the top of mast 40 which would not maintain the trench depth D constant.

The trigonometric analysis to support the foregoing statement is derived as follows:

The distance $X$ (FIG. 2) is equal to the sum of the distance $X1$ and distance $R$ which is a constant. Therefore the distance $D$, the desired depth of the trench being dug relative to the reference plane defined by the laser beam $L$, is equal to: $D = H + R + X_1$.

Therefore, if a constant depth D of the trench is to be maintained, it necessarily follows that the angle A defined between the axis of the endless chain digging frame 11 and the horizontal must be measured and utilized as a modifying signal to the control signals generated by the sensor units 43, and the modified signal applied to the hydraulic cylinders 13*a* and 13*b*. In other words, whenever $H + R + X_1$ departs from $D$, a correcting signal is applied to cylinders 13*a* and 13*b* but $X_1$ varies with digging frame angle A. Hence, the effective height of the mast 40 relative to the bottom of the trench must be modified as a trigonometric function of the digging frame angle $A$ of the endless chain trenching unit.

Figure 3:
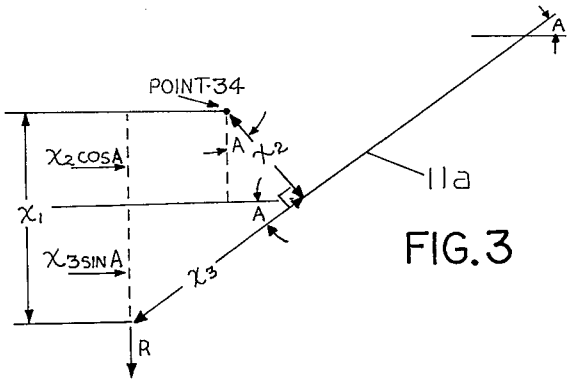
FIG. 3 is a line diagram equivalent of a portion of FIG. 1 to illustrate the trigonometric calculation of the effective digging depth.

Referring to FIG. 3, it is apparent that $X_1 = X_2 \cos A + X_3 \sin A$ where A is the digging frame angle, $X_2$ is the perpendicular spacing between mast pivot axis 34 and the digging frame axis 11*a* which is a line drawn between the axis of frame pivot shaft 2 and the axis of rear sprocket 14*a* and $X_3$ is the spacing between the axis of sprocket 14*a* and the line $X_2$.

The digging frame angle A may be measured by positioning a transducer T between the pendulum pivot pin 33*a* and the support frame 33. The transducer T is of the type that generates an electrical signal when its shaft is pivoted relative to its cylindrical body. For example, a transducer of the type manufactured and sold by Trans-Tek, Inc. of Ellington, Conn. may be utilized.

Conventional circuits may then be employed to generate a signal equal to $X_2 \cos A + X_3 \sin A$ and this signal is added to any signal generated by sensors 43 to control cylinders 1*a* and 1*b* so that depth $D$ remains constant. Obviously if the depth of the trench is required to slope for drainage, it is only necessary to tilt the plane of the rotating laser beam L.

Figure 4:
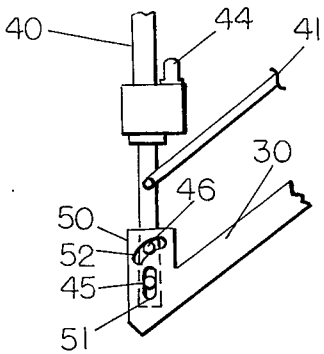
FIG. 4 is a partial view of the trencher of FIG. 1 showing a modification of this invention.

Referring now to FIG. 4, a modification of this invention is illustrated wherein the variation in effective height of the mast 40 is achieved by a mechanical linkage. Instead of the mast 40 being pivotally mounted on the lower end of the sub-frame 30, it is supported between two laterally spaced upstanding plates 50 in such fashion as to permit not only pivotal movement of the mast 40 in a vertical plane but concurrent vertical movement as well. Thus the mast 40 is provided with two vertically spaced sets of cam rollers 45 and 46 which are respectively engaged in a vertical cam slot 51 and an arcuate cam slot 52 provided in the upstanding support plates 50. Cam slot 52 is proportioned to provide the same adjustment in height of sensors 43 as expressed above, namely, the distance $X_1$ is maintained equal to $X_2 \cos A$ plus $X_3 \sin A$.

With this construction, when the trencher digging frame angle A varies due to a variation in the terrain, mast 40 tends to be tilted from a true vertical and the pendulum acts on the mast 40 to restore it to the true vertical position. However, in either direction of pivotal motion of the mast 40 back to the true vertical position, the effective height of the mast 40 is either raised or lowered depending on whether the vehicle 1 is encountering a down slope or an up slope. In either event, the effective height of the mast 40 is varied as a trigonometric function of digging frame angle A of the endless chain trenching unit and concurrently the laser beam sensors 43 generate control signals to the positioning cylinders to change the pivotal position of the trencher relative to the vehicle to immediately restore the sensors 43 to their position of vertical alignment with the reference plane defined by the laser beam L. The trencher depth D thus is maintained constant relative to the reference plane defined by laser beam L.

Modifications of this invention will be readily apparent to those skilled in the art and are intended to be included within the scope of the following claims.

I claim:

1. In a trencher of the type having an elongated digging frame having one end thereof pivotally mounted on a vehicle so that the other end is free for movement in a vertical plane parallel to the path of travel of the vehicle, said digging frame having two spaced sprockets traversed by an endless chain carrying a plurality of spaced digging scoops, means on the vehicle for driving the forward sprocket and power means for varying the pivotal angle of said digging frame relative to the horizontal, thereby determining the depth of the trench dug by said blades, the improvement comprising:

1. means for periodically sweeping a laser beam over the working area where the trench is to be dug, said beam defining a reference plane of known height relative to the desired depth of the trench;
2. an upstanding mast having its bottom end pivotally mounted directly on said digger frame adjacent said other free end thereof and above the rear sprocket for movement in a vertical plane;
3. means for maintaining said mast in a true vertical position irrespective of the angular position of said digging frame whereby the height of said mast varies as a trigonometric function of said pivotal angle and not directly proportional to the trench depth;
4. laser beam sensors carried by the top of said mast;
5. control circuit means responsive to said sensors for operating said power means to vary the angular position of said digging frame to maintain the trench depth at said desired level beneath said beam reference plane and
6. means for concurrently varying the height of said mast as a trigonometric function of the said pivotal angle of said digging frame relative to the horizontal.

2. The combination defined in claim 1 wherein said last mentioned means includes means for measuring variations in the digging frame angle relative to the horizontal, plus means for modifying the signals generated by said sensors by a signal representing a trigonometric function of said digging frame angle.

3. The combination defined in claim 2 wherein said trigonometric function is equal to $X_2 \cos A$ plus $X_3 \sin A$, where A is the digging frame angle relative to the horizontal, $X_2$ is the length of a perpendicular line between the mast pivot axis and a first line drawn between the axes of said frame pivot and the rear sprocket, and $X_3$ is the spacing along said first line between the axis of the rear digging chain sprocket and the said perpendicular line.

4. In a trencher of the type having an elongated digging frame having one end thereof pivotally mounted on a vehicle for movement in a vertical plane parallel to the path of travel of the vehicle, said digging frame providing a mounting for an endless chain carrying a plurality of spaced digging scoops, means on the vehicle for driving said chain and power means for varying the pivotal angle of said digging frame relative to the horizontal, thereby determining the depth of the trench dug by said blades, the improvement comprising:

1. means for periodically sweeping a laser beam over the working area where the trench is to be dug, said beam defining a reference plane of known height relative to the desired depth of the trench;
2. a sub-frame rigidly mounted on said digging frame in overlying relationship thereto;
3. a pair of laterally spaced upstanding plates rigidly secured to said sub-frame;
4. an upstanding mast having its bottom end disposed between said plates and supported thereby for both limited pivotal and vertical movement;
5. means for pivoting said mast to continuously maintain said mast in a true vertical position irrespective of said pivotal angle of the digging frame whereby the height of said mast varies as a function of said pivotal angle and not directly proportional to the trench depth;
6. cam means on said plates for varying the effective height of said mast as a trigonometric function of said pivotal angle of said digging frame;
7. laser beam sensors carried by the top of said mast; and
8. control circuits responsive to said sensors for operating said power means to vary to angular position of said digging frame to maintain the depth of the trench at said desired level beneath said laser beam reference plane.

5. The combination defined in claim 4 wherein said cam means comprises a first opposed pair of vertical slots in said upstanding plates respectively receiving the ends of a first pin traversing said mast, and a second pair of arcuate inclined slots in said upstanding plates respectively receiving the ends of a second pin traversing said mast.

* * * * *

UNITED STATES PATENT OFFICE
CERTIFICATE OF CORRECTION

Patent No. 4,034,490 Dated July 12, 1977

Inventor(s) Ted L. Teach

It is certified that error appears in the above-identified patent and that said Letters Patent are hereby corrected as shown below:

Column 2, lines 7 and 8, cancel "effective height" and substitute -- a --.

Column 2, line 33, cancel "suitable" and substitute -- Suitable --.

Column 3, line 4, cancel "in this In" and substitute -- In this application, --.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*